US006011209A

United States Patent [19]

Liao

[11] Patent Number: 6,011,209

[45] Date of Patent: Jan. 4, 2000

[54] CYMBAL FIXTURE

[75] Inventor: Tsun-Chi Liao, Taichung, Taiwan

[73] Assignee: HWA Shin Musical Instrument Co., Ltd., Taichung, Taiwan

[21] Appl. No.: 09/335,505

[22] Filed: Jun. 18, 1999

[51] Int. Cl.[7] ..... G10D 13/02

[52] U.S. Cl. ..... 84/422.3; 84/422.1; 84/422.2

[58] Field of Search ..... 84/422.1, 422.2, 84/422.3

[56] References Cited

U.S. PATENT DOCUMENTS

| | | | |
|---|---|---|---|
| 5,421,234 | 6/1995 | Liao | 84/422.1 |
| 5,808,217 | 9/1998 | Liao | 84/422.3 |
| 5,883,321 | 3/1999 | Hsieh | 84/422.3 |
| 5,895,168 | 4/1999 | Liao | 403/362 |

*Primary Examiner*—Karen Masih
*Assistant Examiner*—Kim Lockett
*Attorney, Agent, or Firm*—Bacon & Thomas, PLLC

[57] ABSTRACT

An improved clamp structure for cymbal fixing comprises an externally threaded sleeve with a pivot hole for a pull lever to penetrate and extend. The threaded sleeve is provided in sequence from top to bottom with a clamp, two isolating pieces, two cotton blocks, and a fixing nut. An upper cymbal is to be place between the cotton blocks, and a base block beneath the clamp having a through hole is screw-jointed with the threaded sleeve for the pull lever to penetrate and extend. A fixed wing block and a movable wing block located on top of the base block are clamping at the pull lever with two corresponding valleys, so that the threaded sleeve and the upper cymbal can be positioned on the pull lever stably to move after the latter with excellent response.

1 Claim, 5 Drawing Sheets

CYMBAL FIXTURE

BACKGROUND OF THE INVENTION

This invention relates to a cymbal fixture, particularly to an improved clamp structure for cymbal fixing.

The integral structure of a pair of conventional pedal cymbals, as shown in FIG. 1, usually contains a stand with a long tube enclosed therein, and a lower cymbal is anchored on top of the long tube with a clamp, wherein the long tube encloses a pull lever; an upper cymbal is fixed on top of the pull lever with another clamp; and bottom end of the pull lever is connected with a pedal. When the pedal is pressed, the pull lever will be pulled downwards to drive the upper cymbal to strike the lower cymbal to sound; and when the pedal is released, the pull lever will return upwards to its original position by a restoring elastic device (not shown) to detach the upper cymbal from the lower one.

The fixing component used to lock the upper cymbal as shown in FIG. 2 mainly contains a sleeve having an externally threaded shank at lower end and a cap on top end with a relatively larger diameter than that of the threaded shank, wherein the cap and the threaded shank both are provided with a pivot hole in center position respectively for the pull lever to penetrate; and a tapped hole is formed in radial direction of the cap to communicate with the pivot hole for a clamping bolt to get engaged and to push against the pull lever for locking the same.

The threaded shank is further collared with two pieces of cotton blocks for pinching the upper cymbal in-between, wherein top face of the upper cotton block is stopped by bottom end of the cap, and bottom face of the lower cotton block is stopped by a nut for locking the upper cymbal.

It is doubtful about the abovesaid construction if the pull lever can be firmly held merely by a small contact area of the clamping bolt, especially when the upper cymbal moves up and down after the pull lever to strike the lower cymbal frequently and intermittently from time to time during a performance. The latter is to exert a reaction force in each strike to push the former moving upwards bit by bit to worsen the response of the cymbals inevitably while the locking is getting loosened gradually. So that, it is considered a defect needing improvement.

SUMMARY OF THE INVENTION

This invention is proposed to provide an improved clamp structure for cymbal fixing, which is used to clench a pull lever with a relatively larger contact area than that of a conventional clamping bolt for positioning an upper cymbal stably to improve response of the cymbals.

The embodied skill for realizing abovesaid target shall include: providing a clamping socket, two isolating plates, two cotton blocks and a fixing nut in sequence to an externally threaded tube from top to bottom; inserting an upper cymbal between those cotton blocks; screw-fixing a base block in bottom end of the clamping socket onto the threaded tube, which is penetrated with a pull lever; clamping the pull lever by securing a corresponding groove formed between a fixed and a movable wing piece located on upper portion of the clamping socket. By means of foregoing setup, the threaded tube and the upper cymbal located thereon can be firmly positioned on the pull lever to move up and down with better response.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
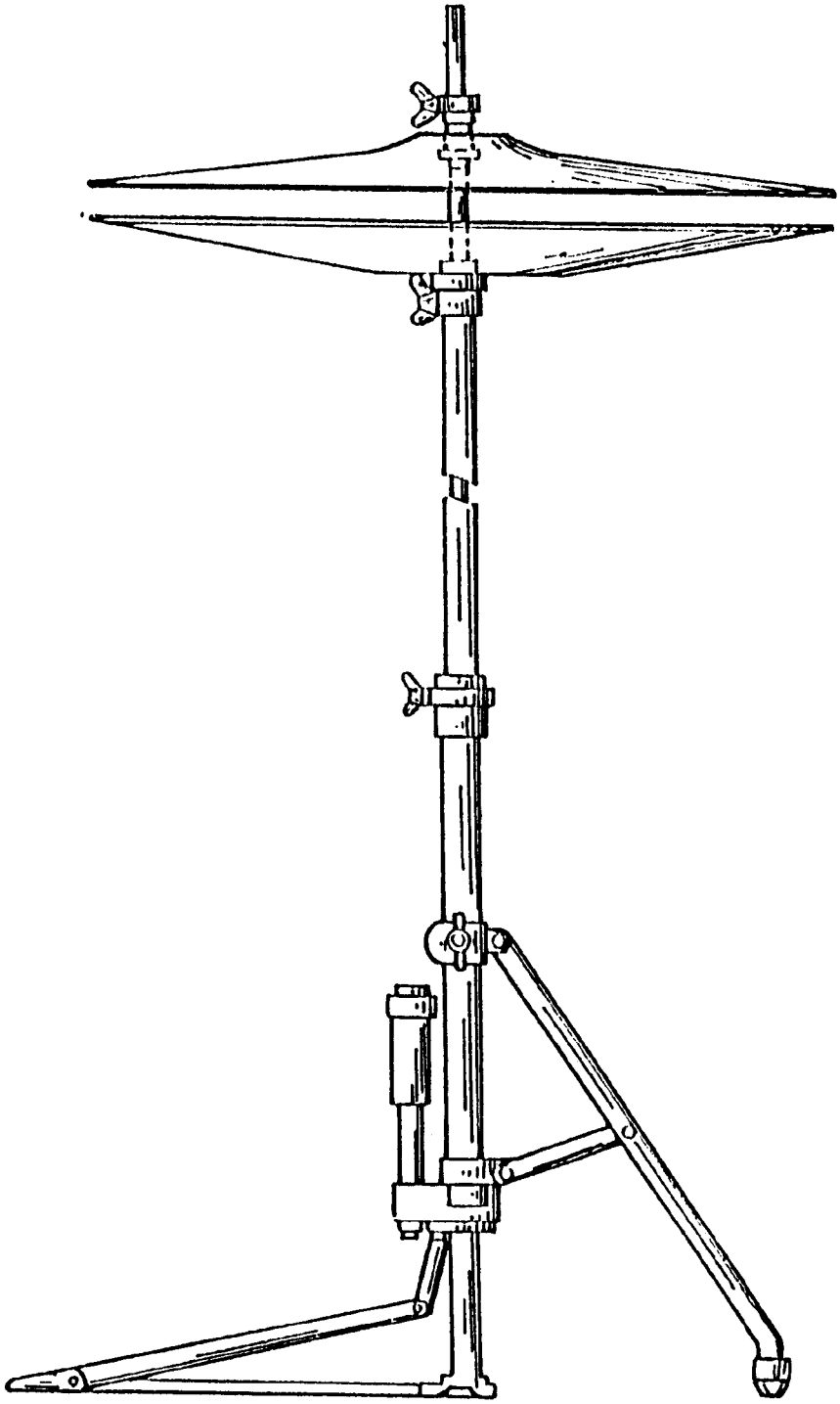
Fig. 1 PRIOR ART
FIG. 1 is a schematic view showing integral structure of the conventional pedal-controlled cymbals according to the prior art.
Figure 2:
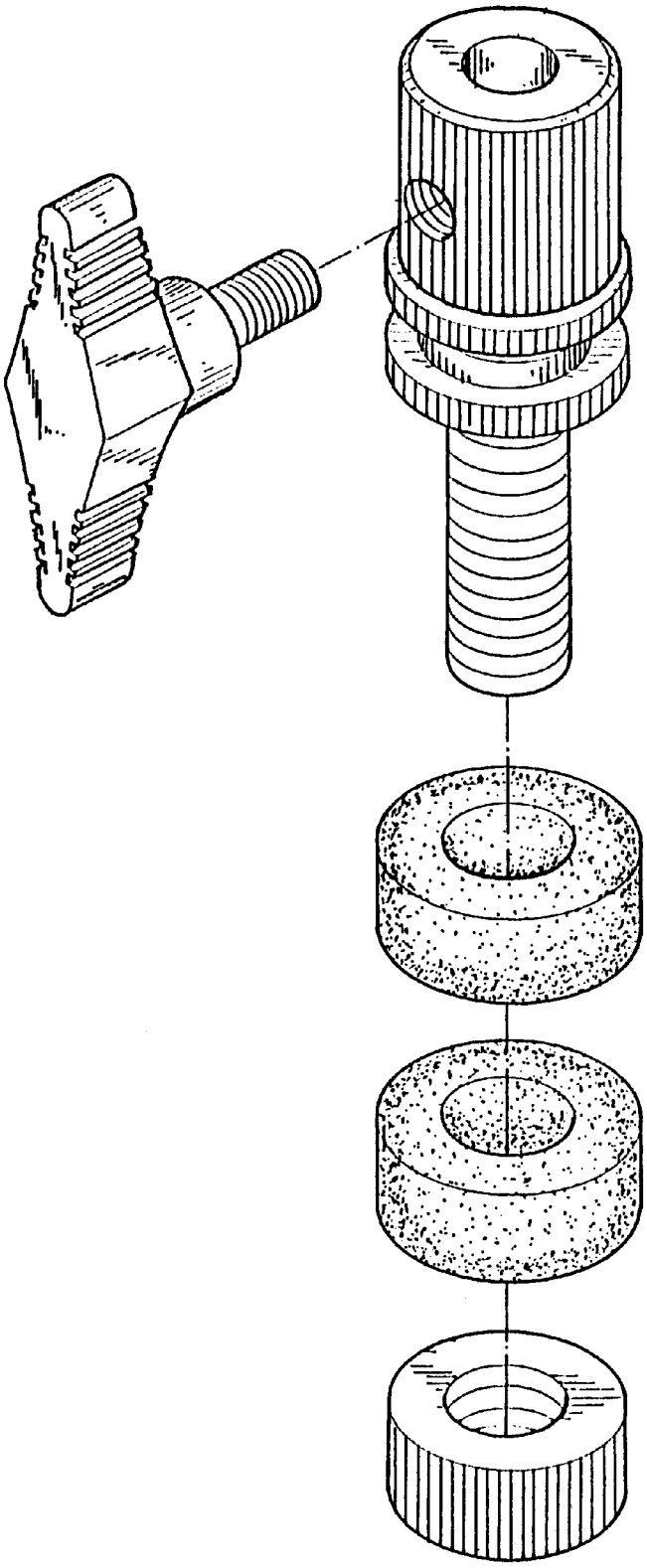
Fig. 2 PRIOR ART
FIG. 2 is a three-dimensional exploded view of the conventional fixing clamp for cymbals according to the prior art.
Figure 3:
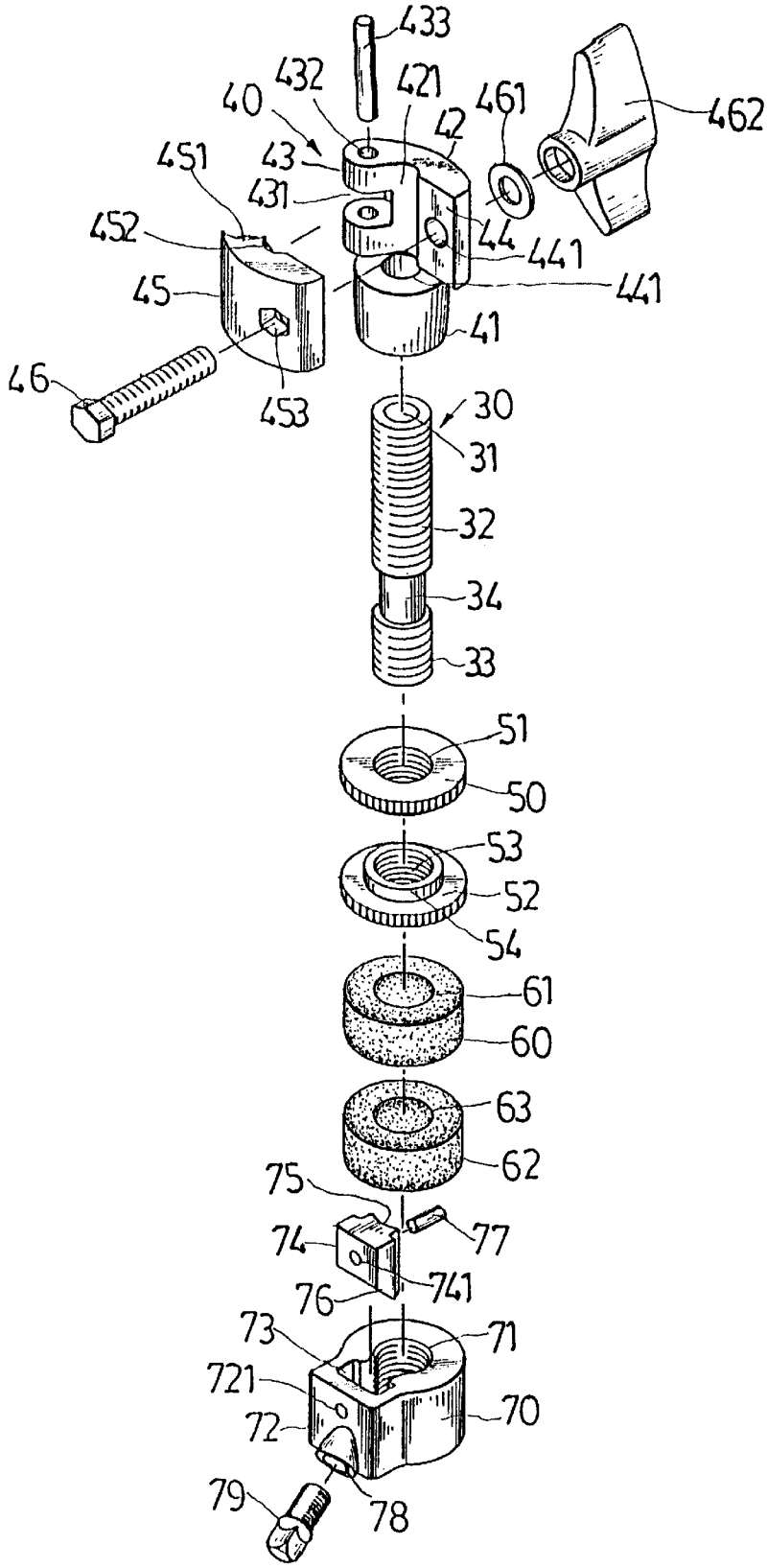
FIG. 3 is a three-dimensional exploded view of this invention.
Figure 4:
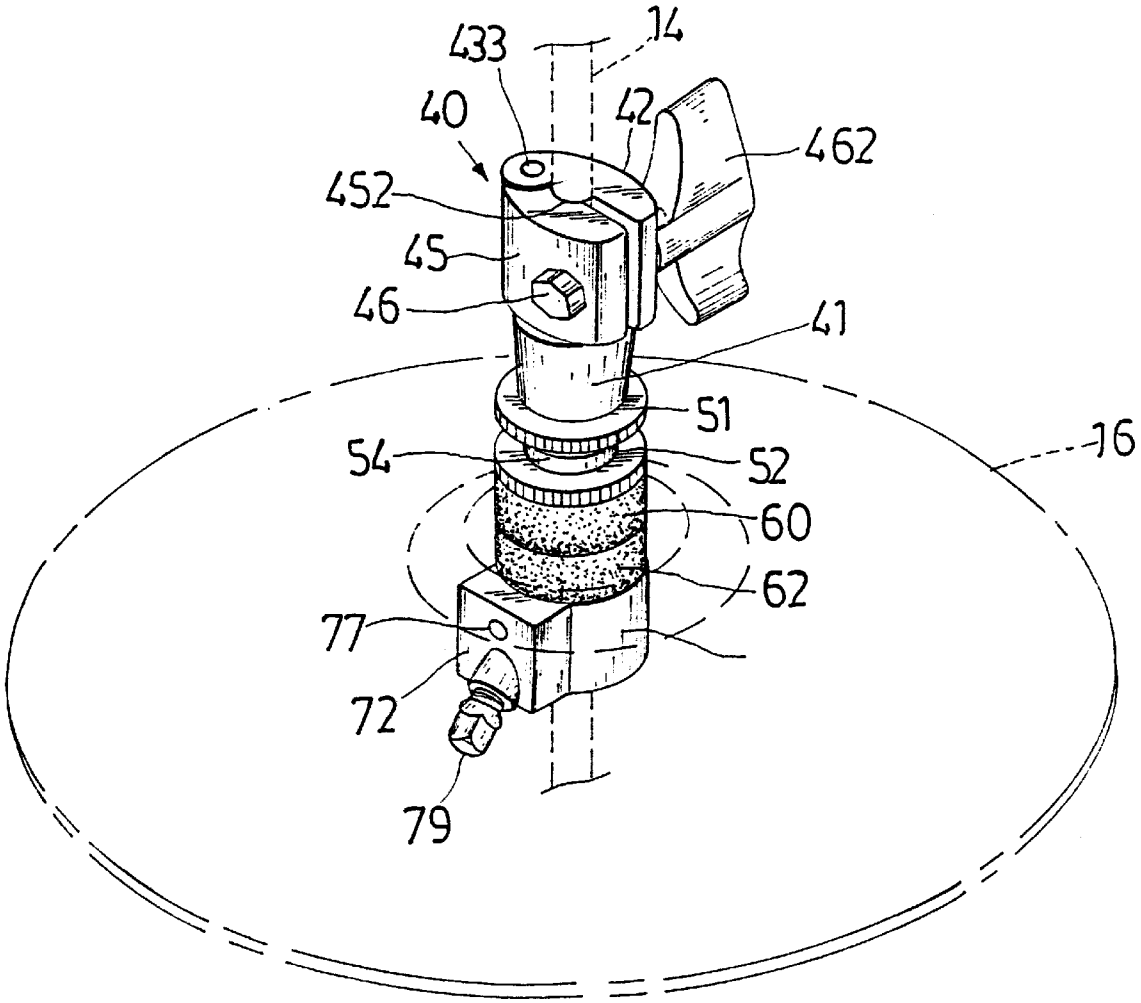
FIG. 4 is an assembled lateral view of this invention.
Figure 5:
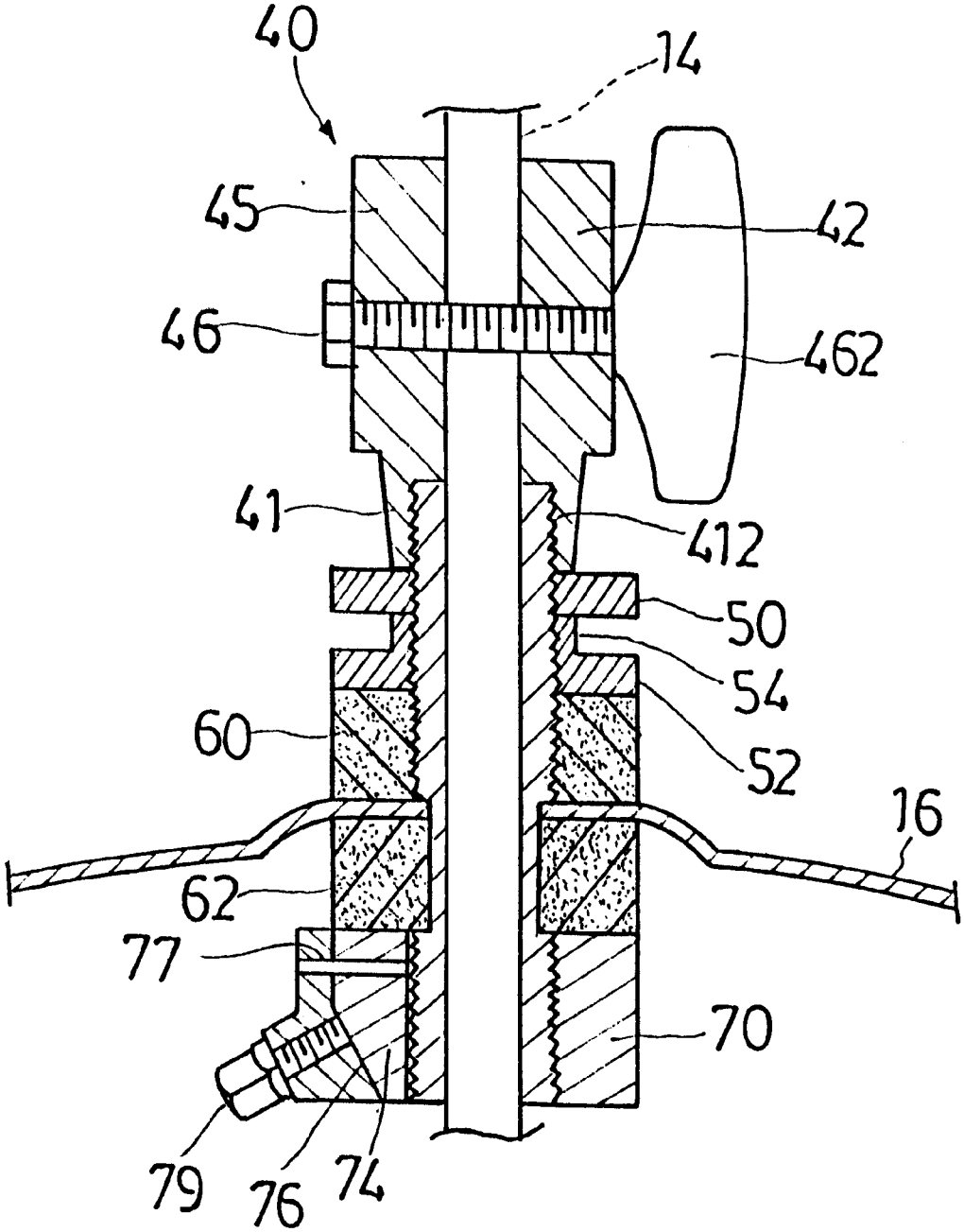
FIG. 5 is an assembled cutaway sectional view of this invention.

Referring to FIG. 3, 4, and 5, an improved clamp structure for cymbal fixing of this invention comprises an externally threaded sleeve 30, a clamp 40, an upper isolating piece 50, a lower isolating piece 52, an upper cotton block 60, a lower cotton block 62, and a fixing nut 70.

The threaded sleeve 30 having a penetrated pivot hole 31 in center and threads on external face is divided into three segments an upper thread segment 32, a lower thread segment 33, and a smooth segment 34 with a relatively shorter diameter located between the thread segments 32, 33.

The clamp 40 having a base block 41 at bottom end, wherein a through hole 411 in diameter corresponding with the pivot hole 31 is formed in center of the base block 41; a lower portion of the through hole 411 is broadened to form a tapped hole 412 for accommodating and locking the upper end of the thread sleeve 30; a fixed wing block 42 in semi-arc is placed on top of the base block 41; and on central surface of the wing block 42, a valley 421 is formed vertically. The fixed wing block 42 is further divided into a pin connection end 43 at one side and a coupling end 44 at another, wherein a through hole 441 is arranged in central portion of the coupling end 44; the pin connection end 43 is cross sectioned at middle portion to form an opening 431 for receiving a protruding piece 451 of a movable wing block 45; a pin hole 432 is disposed vertically in the pin connection end 43 and the protruding piece 451 for penetrating and fixing a pin 433 to enable the movable wing block 45 to open or close; in a position on surface of the movable wing block 45 opposite to the valley 421 of the fixed wing block 42, another valley 452 is formed; and a hexagonal hole 453 is formed in the movable wing block 45 in a position corresponding with the through hole 441 in the fixed wing block 42 for penetrating and locking a hexagonal pin 46 with a washer 461 and a hinge nut 462.

The conventional pull lever 14 can be inserted in the clamp structure of this invention described until now by: opening the movable wing block 45, inserting the pull lever 14 in the valley 421 of the fixed wing block 42 and deep into the pivot hole 31 in the threaded sleeve 30 via the through hole 411 of the base block 41, then, closing the movable wing block 45 and locking the hinge nut 462 to fix the pull lever 14 in the valleys 421, 452 of the fixed wing block 42 and the movable wing block 45.

The upper isolating piece 50 having a tapped hole 51 in center position is to be screw-jointed to the threaded sleeve 30 under the base block 41.

The lower isolating piece 52 having a tapped hole 53 in center position is to be screw-jointed to the threaded sleeve 30 under the upper isolating piece 50, wherein a protruding ferrule 54 is disposed on top of the lower isolating piece 52 to press against bottom of the upper isolating piece 50.

The upper cotton block 60 having a through hole 61 in center position is used to collar on the threaded sleeve 30 under the lower isolating piece 52.

The lower cotton block 62 having a through hole 63 in center position is used to collar on the threaded sleeve 30 at the smooth segment 34. An upper cymbal 16 mentioned in foregoing description of the prior art will be pinched between the upper and the lower cotton block 60, 62. In regard to the upper and the lower isolating piece 50, 52 and the upper and the lower cotton block 60, 62, which are transferred directly from the conventional skills shall not be reiterated here.

A fixing nut 70 having a tapped pivot hole 71 for screw-locking to the lower thread segment 33 of the thread sleeve 30 is used to push the lower cotton block 62 upwards to enable the upper and the lower cotton block 60, 62 to pinch the upper cymbal 16 closely. A protruding portion 72 formed in outer circumference of the fixing nut 70 provides an empty room 73 communicating with the tapped pivot hole 71, wherein a packing piece 74 with a concave packing face 75 is to be inserted in the empty room 73; a slope face 76 is formed at bottom end of the packing piece 74. A pin hole 741, 721 is arranged correspondingly in respective wall of the packing piece 74 and the protruding portion 72 to allow penetration of a pin 77 to position the packing piece 74 in the empty room 73, which can move along longitudinal direction of the pin 77. An oblique tapped hole 78 is disposed in outer face near bottom end of the protruding piece 72 to communicate with the empty room 73 and allow a bolt 79 to lock on and push with its inner end against the slope face 76 of the packing piece 74. So that, the packing face 75 of the packing piece 74 will in turn push against the lower thread segment 33 to anchor the fixing nut 70 at the threaded sleeve 30.

In virtue of abovesaid structure of this invention, when the hinge nut 462 of the clamp 40 locks the hexagonal bolt 46 tightly to pack the fixed wing block 42 and the movable wing block 45 together, the valleys 421, 452 in the clamp 40 will be forced to embrace the pull lever 14 very closely. As the pull lever 14 is embraced by entire external area of the section embraced, the contact area is obviously far larger than that of a clamping bolt used in the conventional structure to thus provide a more powerful constrain force for fixing the pull lever 14.

Further, as an upper cymbal 16 is positioned by the upper and lower isolating piece 50, 52, the upper and lower cotton block 60, 62, and the fixing nut 70, etc, at the threaded sleeve 30, it is anchored stably to the pull lever 14 accordingly, and it will move in good response together with the pull lever 14. When the upper cymbal 16 descends to strike at a lower cymbal to suffer a reaction force, it will not be displaced due to a firm grasp of the lamp 40 to the pull lever 14.

Whenever a positional trimming of the upper cymbal is desired, all a user has to do is loosen the hinge nut 462 of the clamp 40 to disengage the fixed and the movable wing block 42, 45, so that the clamp 40, the threaded sleeve 30 and related components thereon can be moved sliding on the pull lever 14 until a desirable position is reached, then lock again the hinge nut 462 to set it completed.

Although, this invention has been described in terms of preferred embodiments, it is apparent that numerous variations and modifications may be made without departing from the true spirit and scope thereof, as set forth in the following claims.

What is claimed is:

1. An improved clamp structure for cymbal fixing, comprising:

an externally threaded sleeve having a penetrated pivot hole for a pull lever to penetrate and extend, said threaded sleeve being provided in sequence from top to bottom with a clamp, two isolating pieces, two cotton blocks, and a fixing nut, wherein: a base block is disposed beneath said clamp; a through hole in diameter corresponding with that of said pivot hole is formed in said base block for said pull lever to penetrate and extend; a lower portion of said through hole is broadened to form a tapped hole in a diameter corresponding with that of said threaded sleeve to enable an upper end of the latter to get locked;

a fixed wing block in semi-arc is disposed on top edge of said base block; a vertically oriented valley is formed on inner face of said fixed wing block at a position corresponding with said through hole; one end of said fixed wing block is traverse perforated to create a through hole, while the other end allows a pin to penetrate vertically to interlock a movable wing block;

a vertically oriented valley is formed on inner face of said movable wing block at a position corresponding with said valley of said fixed wing block; a hexagonal hole is provided to said movable wing block at a position corresponding with said through hole of said fixed wing block for a hexagonal bolt to penetrate and get locked with a hinge nut, so that those said valleys, will embrace each other to hold and clamp at said pull lever tightly.

* * * * *